US005195820A

United States Patent [19]

Rehberg

[11] Patent Number: 5,195,820

[45] Date of Patent: Mar. 23, 1993

[54] FIREPLACE WITH SIMULATED FLAMES

[75] Inventor: Thomas R. Rehberg, Anaheim, Calif.

[73] Assignee: Superior Fireplace Company, Fullerton, Calif.

[21] Appl. No.: 822,969

[22] Filed: Jan. 21, 1992

[51] Int. Cl.[5] ..... F24C 3/00; A47G 1/12

[52] U.S. Cl. ..... 362/523; 126/500; 392/348; 428/13

[58] Field of Search ..... 428/13, 15; 126/500, 126/523, 512; 392/348; 362/523

[56] References Cited

U.S. PATENT DOCUMENTS

| | | | |
|---|---|---|---|
| 566,564 | 8/1896 | Dewey | 392/348 |
| 4,726,351 | 2/1988 | Whittaker et al. | 392/348 |
| 4,738,522 | 4/1988 | Lund et al. | 353/28 |
| 4,965,707 | 10/1990 | Butterfield | 362/96 |

*Primary Examiner*—Allen M. Ostrager

*Attorney, Agent, or Firm*—Christie, Parker & Hale

[57] ABSTRACT

A simulated-flame fireplace having a housing with a firebox which can be viewed through a transparent front door panel. A translucent simulated ember bed rests on the floor of the firebox, and a log-supporting andiron rests on the ember bed. A video-image projector is mounted on the housing to project an image of an actual wood fire into the firebox. A beam-splitting transparent and partial reflecting panel is supported within the firebox to reflect the flame image toward a viewer, and to enable direct viewing of the firebox interior. The projection and beam splitter are oriented to create a viewer-perceived illusion of the flame image as superimposed on the logs as in an actual log-burning fireplace. The illusion may be enhanced by the addition of audio reproduction of fire sounds, and variable-intensity lighting of the firebox walls and ember bed.

10 Claims, 5 Drawing Sheets

FIREPLACE WITH SIMULATED FLAMES

BACKGROUND OF THE INVENTION

The original primary purpose of a log-burning fireplace was to heat a room, but now of at least equal importance is the charm and ambiance provided by the appearance and sound of a log fire. It is for this reason that a fireplace is still a highly desired fixture in both residential and public spaces which are already comfortably heated by modern air conditioning.

There are many situations in which a fireplace would be desirable to enhance the appearance of a space, but where a conventional installation is not possible or practical due to cost, safety or building-regulation considerations. A conventional fireplace of course requires a flue or chimney to exhaust smoke and combustion products from the burning logs to the outdoors. It is usually impractical or excessively expensive to add a chimney to a completed structure such as a premium hotel room, or to a open lobby space in which a flue would be unattractive.

The presence of an open flame in certain kinds of enclosed spaces may also be unacceptable from a safety standpoint. It is for this reason that conventional fireplaces are not found in aircraft and boats, or in areas where unattended children may be present. It would be desirable to provide a safe "cold" fireplace for applications of that types just described, and it is to this objective that the present invention is directed.

The invention in part utilizes projected-image technology disclosed in U.S. Pat. No. 4,738,522—Lunde et al., and assigned to Technifex. For brevity, the disclosure of the patent is incorporated herein by reference.

SUMMARY OF THE INVENTION

This invention relates to a simulated-flame fireplace assembly having a housing which surrounds a simulated firebox having a front wall with a transparent glass panel. Supported on a simulated ember bed on the floor of the firebox is an andiron which holds a set of simulated wood logs. A TV-monitor video projector is mounted on the top of the housing with an image screen positioned at the top of the firebox, and is driven by a video-image storage and reproducing system such as a video-tape or high-definition laser-disk machine. Stored on the disk is a dynamic image of a flame of an actual fireplace as recorded over a period of say twenty or thirty minutes.

A transparent and partially reflecting beam-splitting panel is supported within the firebox beneath the video projector. The panel slopes upwardly and rearwardly from the front floor of the firebox in front of and over the andiron and simulated logs. The dynamic flame image from the projector is reflected by the beam-splitting panel forwardly to a viewer looking at the front of the assembly, and the flames are perceived by the viewer as superimposed on and apparently emanating from the logs which are viewed directly through the panel.

The simulation of an actual log-burning fireplace can be enhanced by reproduction of an audio track which stores the sound of an actual log fire. The simulation is further emhanced by undersurface variable illumination of a translucent ember bed, and variable-intensity amber illumination of the firebox walls.

DETAILED DESCRIPTION OF THE PREFERRED EMBODIMENT

Figure 1:
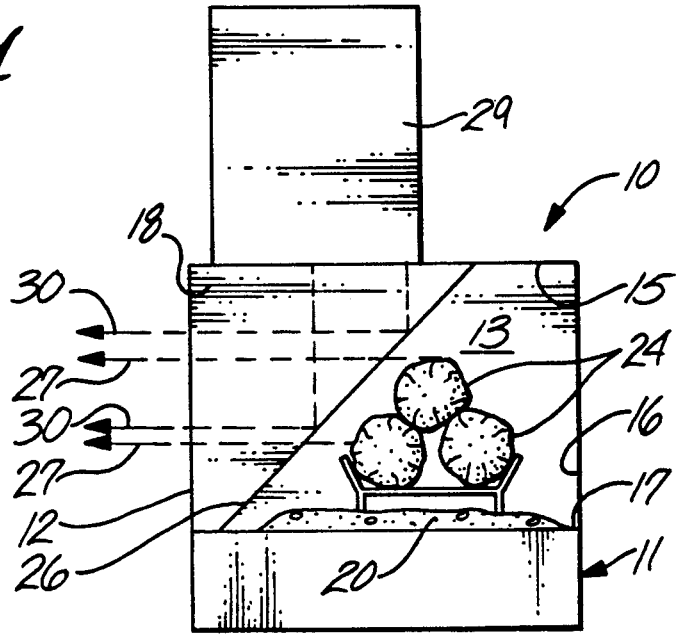
FIG. 1 is a schematic side view of the major elements of a simulated-flame fireplace according to the invention.

FIG. 1 is a schematic representation of the major elements of a simulated-flame fireplace assembly 10 according to the invention. The assembly includes a housing 11 with a transparent front panel 12, and which encases a simulated firebox 13 with top, rear, bottom and side walls 15, 16, 17 and 18, respectively. A simulated ember bed 20 rest on bottom wall 17 and overlies an opening 22 (FIG. 7) in the bottom wall. An andiron 23 rests on the ember bed, and supports a set of simulated wood logs 24.

A transparent and partially reflecting beam-splitting panel 26 (of the type described in the aftermentioned U.S. Pat. No. 4,738,522) is supported in the firebox, and is seen edge on in FIG. 1. The panel extends the full width of the firebox, and is angled upwardly and rearwardly from the forward part of bottom wall 17 to the rearward part of top wall 15. The interior of the firebox can be viewed directly through front panel 12 and beam-splitting panel 26 as suggested by light rays 27 from the logs.

A conventional video monitor 29 of about 25-inch screen size is supported on the top wall of the housing, and a screen image is projected downwardly by the monitor through an opening in the housing to be reflected toward an outside viewer by the beam-splitting panel as suggested by light rays 30. The monitor is coupled to and driven by an image storage and playback device 31 (FIG. 6) such as a commercially available videotape reproducer or preferably a laser-disk reproducer.

A previously recorded tape or disk is installed in playback device 31, and stores images of an actual flame of a conventional wood-burning fireplace as recorded over a period of about twenty or thirty minutes. The playback device is arranged for continuous reproduction of the stored sequence of flame images, and the laser-disk reproducer is preferred as it permits near-instantaneous replay of the sequence without tape-rewind delays.

The optical superpositioning by the beam-splitter panel of the flame image on the log set creates a perfect visual illusion to the viewer of an actual wood-burning fireplace. Preferably, andiron 23 and logs 24 are identical to those used in recording the actual fire, and the projected image of the components is exactly superimposed on the corresponding assembly components as an aid in initial optical alignment of the video monitor and beam-splitting panel.

Figure 2:
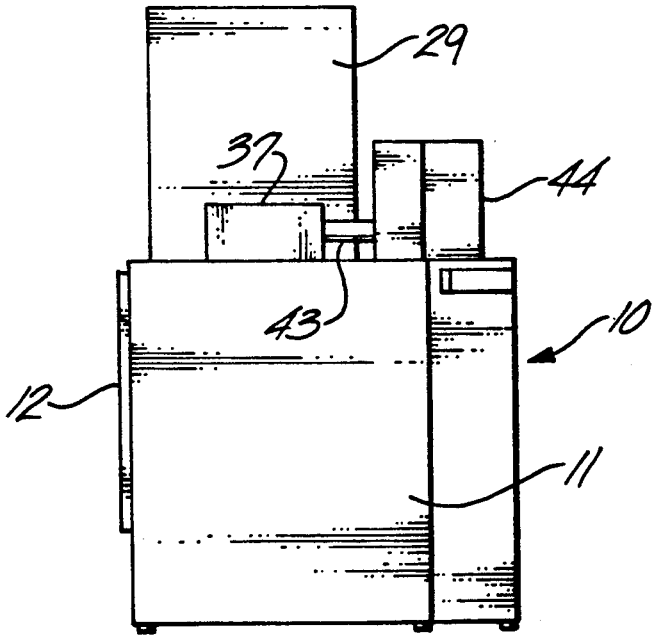
FIG. 2 is a side elevation of the fireplace assembly.
Figure 3:
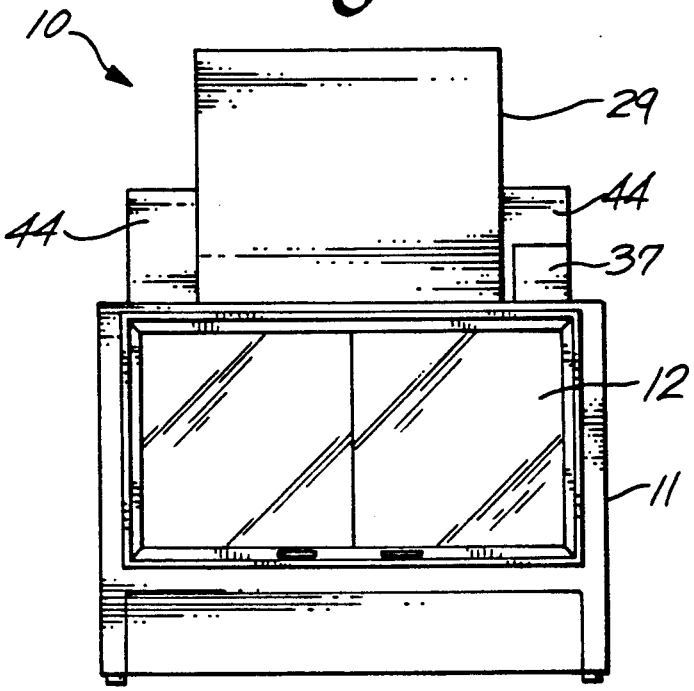
FIG. 3 is a front view of the assembly.
Figure 4:
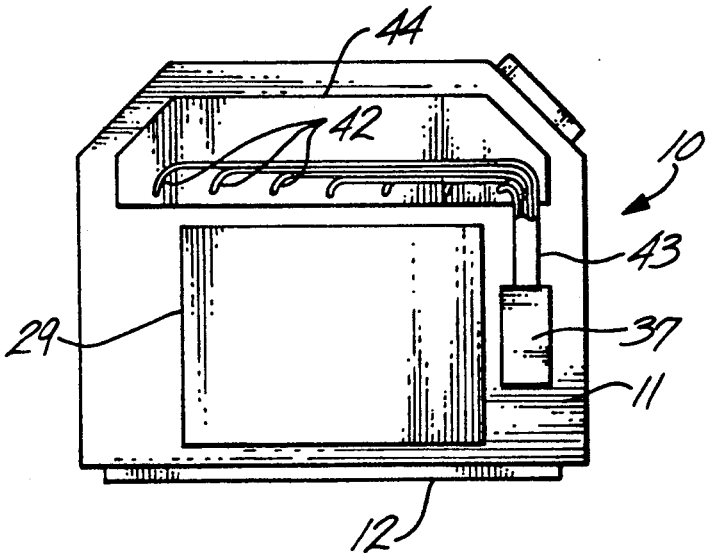
FIG. 4 is a top view (partly broken away) of the assembly.

FIGS. 2, 3 and 4 show in greater detail the placement of the various components of assembly 10. Front panel 12 is preferably shaped to simulate conventional glass doors as used in factory-built fireplaces, but the doors are not hinged as it is desirable to maintain the firebox in a sealed condition t o avoid dust and fingerprints on the beam-splitting panel which must be clean to be substantially invisible to the viewer. The front panel is removable, however, to permit periodic cleaning and initial setup adjustment of the assembly optical components.

Figure 6:
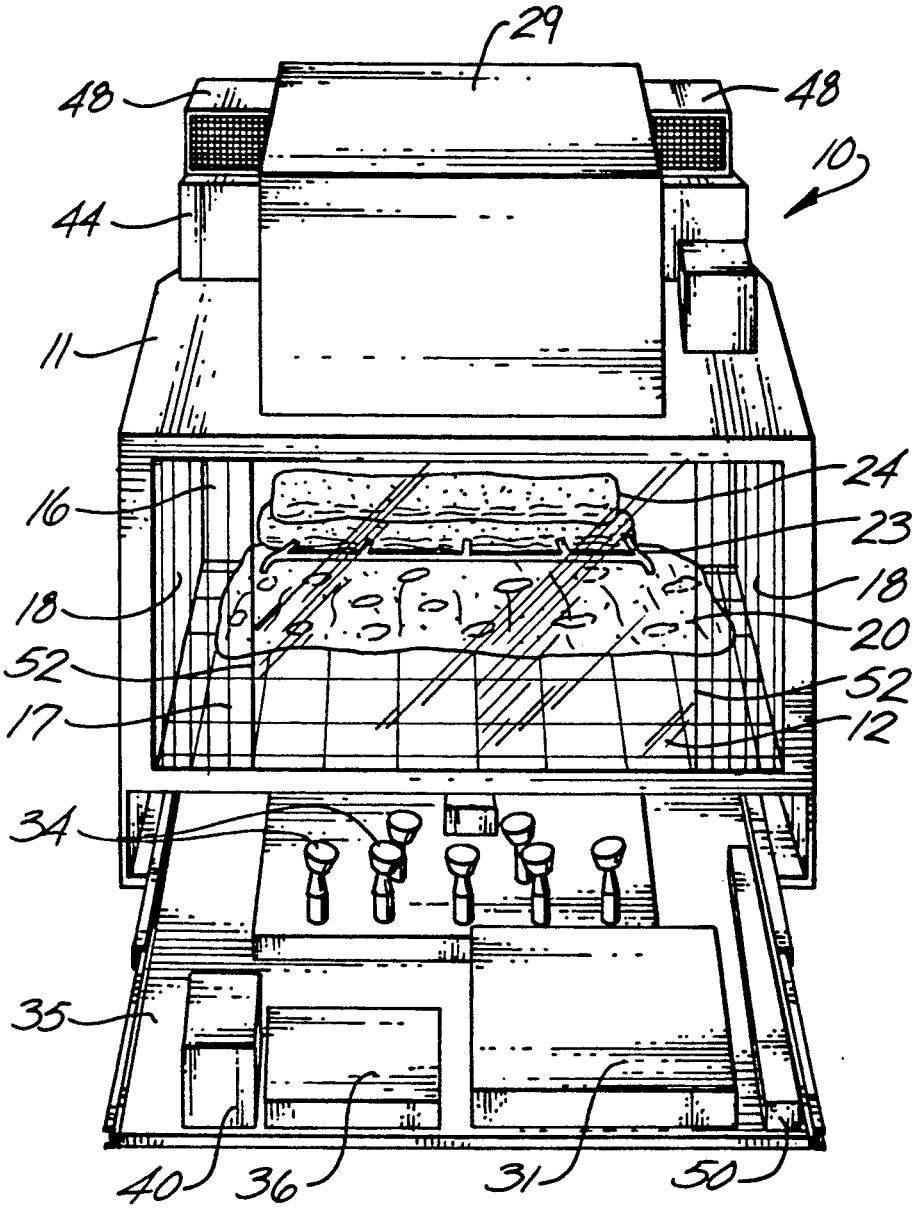
FIG. 6 is a pictorial view showing the top and front of the assembly with an extended lower equipment drawer.
Figure 7:
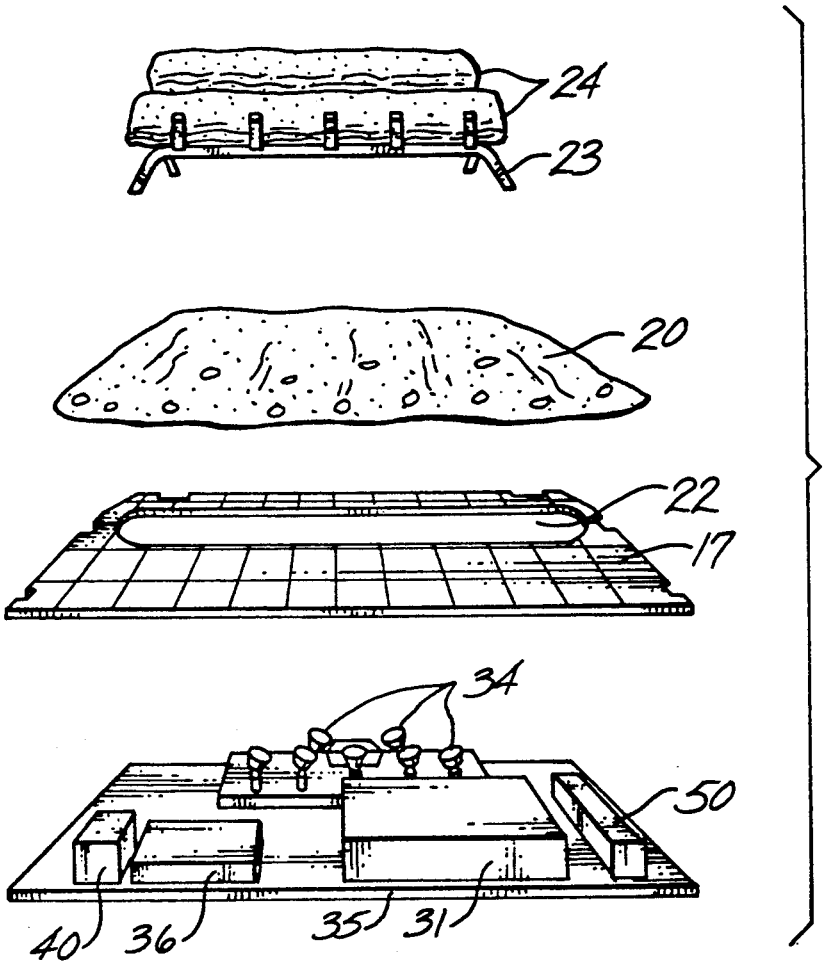
FIG. 7 is an exploded view of the equipment drawer, a firebox floor panel, a simulated ember bed, and an andiron and log set.

The visual illusion of an actual wood burning fireplace is preferably enhanced by the use of an illumination means which has two subsystems. The first subsystem is shown in FIGS. 6 and 7, and includes a plurality of lamps 34 (spotlights of about 30-watt size are suitable) which are supported in sockets at the rear of a drawerslide-mounted base panel 35 at the bottom of housing 11.

The spotlights are angled to illuminate the undersurface of ember bed 20 through opening 22 in firebox bottom wall 17. The ember bed is translucent (and typically of fiberglass construction) so illumination from the spotlights is dispersed in and viewable from the outside of the assembly. The upper surface of the ember bed is gray colored, and the undersurface is painted with a pattern of red and orange such that the illuminated ember bed appears to the viewer as an accurate simulation of the underlog glowing embers of a wood-burning fireplace.

Lamps 34 are preferably driven by a programmable variable-voltage source 36 such as offered by Monarch Lighting Company under the trademark "Synthaflame." This power supply provides a voltage which constantly varies to give the lamp output a flickering quality, and preferably each lamp can be individually programed to enhance the simulation of an actual glowing ember bed.

Figure 5:
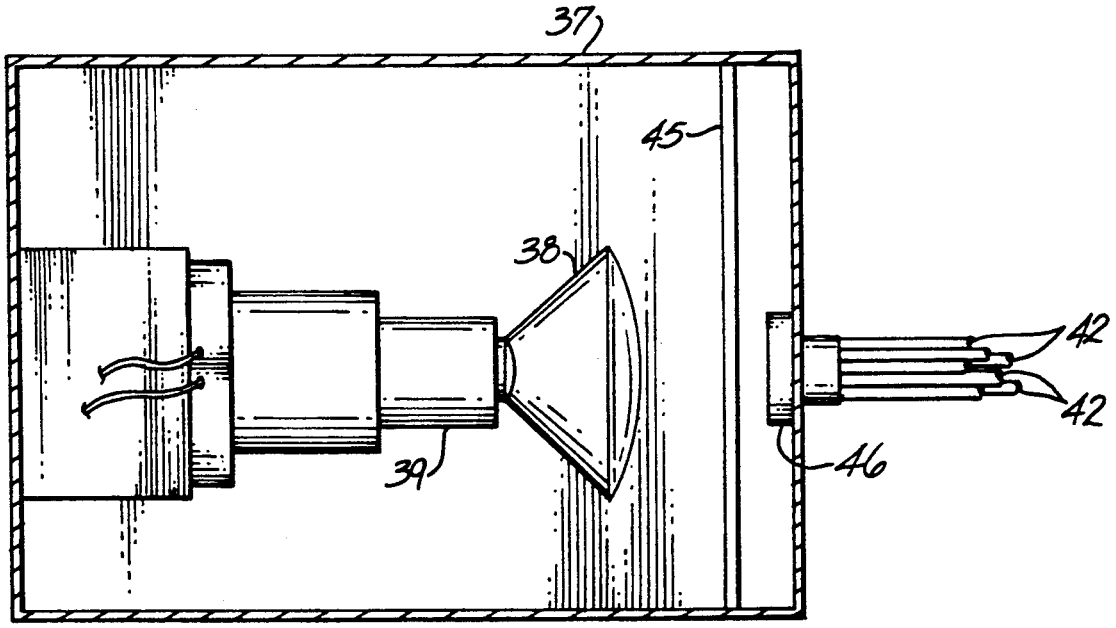
FIG. 5 is a sectional side elevation of a light source and fiber-optic system for illuminating interior walls of a firebox of the assembly.

The second illumination subsystem is best seen in FIGS. 4 and 5, and includes a lamp housing 37 mounted on the top of housing 11 on one side of video monitor 29. A halogen lamp 38 is supported by a socket 39 within the housing, and the lamp is driven by a second variable-voltage "flicker" source 40 (FIG. 6) of the type just described, and connected thereto by cabling (not shown).

Lamp 38 brightly illuminates the input ends of a plurality of fiber-optic light-transmitting cables 42 which are enclosed in a sheath 43. The cables and sheath extend from housing 37 into a shield-like housing 44 on the rear upper surface of housing 11 behind video monitor 29. The output ends of the individual fiber-optic cables extend downwardly through housing 11 and firebox top wall 15, and are oriented to project flickering light to the sidewalls and the rear and bottom walls of the firebox.

A transparent heat-reflecting glass panel 45 (FIG. 5) is positioned between lamp 38 and the input ends of fiber-optic cables to prevent overheating of the fiber-optic bundle. An amber glass filter 46 is supported by housing 37 over the input ends of the fiber-optic cables such that the light transmitted to the inner wall surfaces of the firebox closely simulates the color and gentle flickering of the light emitted by a wood-log fire.

Another enhancement of the overall simulation is achieved by providing an audio track in playback device 31, and on which is stored the recorded gently cracking sound of a actual wood-burning fireplace. One or more speakers 48 to reproduce the recorded sounds are shown in FIG. 6 as positioned on the top of housing 44, but the speakers can alternatively be placed at any other convenient location. Cabling of the speakers to the playback device is omitted in the drawings for clarity, as is cabling for the other electrical components, and only a line-power outlet box 50 is shown in FIG. 6.

If desired, an even further simulation enhancement can be provided by fitting a forced-air electrical heater (not shown) in housing 11 to eject warm air through a plenum which is vented to the space in front of the fireplace assembly through an opening in the lower front surface of housing 11. The heated air may optionally be passed over an aroma-emitting substance which simulates the smell of combustion-product gasses of a natural wood fire.

The electrical components are controlled by an on-off switch (not shown) which can be mounted on housing 11, or alternatively remotely located in the room in which the assembly is installed. If an audio track is included, a conventional volume control is also provided, and all of these controls may optionally be provided by a remote control of a conventional type.

Assembly 10 is suitable for in-wall mounting such that only the surface of transparent front panel 12 is seen by viewers. Alternatively, the assembly may be mounted in a separate decorative housing for free-standing placement on the floor of a room.

Housing 11 is preferably of sheet-metal construction as conventionally used in factory-built fireplaces. Firebox 13 is made of plywood panels, and the inner surfaces of these panels is painted gray, and textured (FIG. 6) to simulate the appearance of refractory brick used in conventional fireplaces. Other decorative features may be added to the assembly to enhance the simulation effect, and, for example, a fireplace screen (not shown, but suggested in an open position by lines 52 in FIG. 6) may be fitted on transparent front panel 12.

What is claimed is:

1. A simulated-flame fireplace assembly, comprising:

a housing surrounding and supporting a simulated firebox, the firebox having back, side, top and bottom walls, and a front wall with a transparent door panel, the housing further including a simulated ember bed on the firebox bottom wall, and a log set with an andiron resting on the ember bed and a log supported on the andiron;

an image projector mounted on the housing and arranged to project a recorded image of fireplace flames into the firebox;

a transparent and partially reflecting beam-splitting panel disposed within the firebox and arranged so the projected flame image appears to an outside viewer to be superimposed on the log and a firebox space around the log.

2. The assembly defined in claim 1, and further comprising means for reproducing an audible sound simulating the sound of a log-burning fireplace.

3. The assembly defined in claim 1 in which the ember bed is translucent, and further comprising firebox illumination means for illuminating the undersurface of the translucent ember bed with varying light, whereby the ember bed has a appearance to the outside viewer of variably glowing ember bed of a log-burning fireplace.

4. The assembly defined in claim 3, and in which the illumination means further includes for illuminating the firebox back and side walls with variable-intensity light of a color which simulates that emitted by a log-burning fireplace.

5. The assembly defined in claim 1, and further comprising a forced-air heating means for delivering warmed air from the housing to a space adjacent the firebox front wall.

6. The assembly defined in claim 5, in which heating means includes odorizing means for providing an aroma of a wood-burning fireplace to the delivered warm air.

7. The assembly defined in claim 1 in which the image projector comprises a laser-disk system for storing and reproducing signals representing said fireplace-flame image, and a television monitor connected to the system for displaying and projecting the image to the beam-splitting means.

8. A simulated-flame fireplace assembly, comprising:

an outer housing;

a simulated firebox supported within the housing and having a front wall with a transparent portion, and top, rear, bottom and side walls;

a simulated ember bed supported on the bottom wall of the firebox;

an andiron supported on the ember bed, and a plurality of logs on the andiron;

an immediate-replay image projector adjacent the housing and positioned to project a dynamic recorded image of an actual log fire through an opening in the firebox into the firebox interior; and a transparent and partially reflective beam splitting panel supported within the firebox and optically aligned to create an illusion of the projected log-fire image being superimposed over the logs when the logs are viewed through the transparent portion of the front wall.

9. The assembly defined in claim 8, and further comprising variable illumination means for illuminating the interior of the firebox and the ember bed with a flickering light simulating flame illumination in a log-burning fireplace.

10. The assembly included in claim 9 in which the image projector includes an audio track with stored sounds of an actual log fire, and means for reproducing such sounds.

* * * * *